United States Patent [19]

Blumberg

[11] Patent Number: 5,007,758

[45] Date of Patent: Apr. 16, 1991

[54] FILE FOLDER

[75] Inventor: Murray B. Blumberg, Woodmead Springs, South Africa

[73] Assignee: Press Engineering Pty. Ltd., Johannesburg, South Africa

[21] Appl. No.: 460,506

[22] Filed: Jan. 3, 1990

[51] Int. Cl.[5] ..... B42F 13/00

[52] U.S. Cl. ..... 402/75; 229/1.5 R

[58] Field of Search ..... 402/75, 74, 70, 78, 402/77, 76, 79; 229/1.5 R

[56] References Cited

U.S. PATENT DOCUMENTS

| | | | |
|---|---|---|---|
| 421,028 | 2/1890 | Jones . | |
| 629,601 | 7/1899 | Pope | 402/75 |
| 910,194 | 1/1909 | Harris . | |
| 1,012,182 | 5/1933 | Di Girolamo et al. . | |
| 1,096,181 | 5/1914 | Mieden . | |
| 1,138,872 | 5/1915 | Hub, Jr. . | |
| 1,500,339 | 7/1924 | Smiley, Jr. . | |
| 1,577,558 | 3/1926 | Brown et al. . | |
| 1,652,205 | 12/1927 | Kline . | |
| 1,665,128 | 4/1928 | Cather . | |
| 1,665,705 | 4/1928 | Kline . | |
| 1,744,948 | 1/1930 | Buckland . | |
| 1,930,648 | 10/1933 | Kline . | |
| 2,005,717 | 6/1935 | Coulston . | |
| 2,265,404 | 12/1941 | Stark . | |
| 2,336,619 | 12/1943 | Karlen . | |
| 2,596,600 | 5/1952 | Rice . | |
| 2,599,768 | 6/1952 | Losch, Jr. | 402/79 |
| 2,725,881 | 12/1955 | Goldman . | |
| 3,271,829 | 9/1966 | Corey . | |
| 4,192,620 | 3/1980 | Jahn . | |
| 4,261,664 | 4/1981 | Crawford | 402/77 |
| 4,285,104 | 8/1981 | Corey et al. . | |
| 4,511,298 | 4/1985 | Jones | 402/75 |

FOREIGN PATENT DOCUMENTS

| | | |
|---|---|---|
| 220340 | 1/1957 | Australia . |
| 1128839 | 5/1962 | Fed. Rep. of Germany . |

*Primary Examiner*—Stephen P. Garbe

*Attorney, Agent, or Firm*—Wood, Herron & Evans

[57] ABSTRACT

A combination file folder and fastener for securing loose papers to the folder. The folder has a flap cut along a hinge line about which the flap is pivotable. There is a cover strip which covers a portion of the outside of the folder including the flap. A central portion of the fastener is sandwiched between the cover strip and the flap with the ends or prongs of the fastener extending into the interior of the folder such that loose papers may be positioned over the prongs and thereby secured within the folder.

12 Claims, 5 Drawing Sheets

FILE FOLDER

This invention relates to paper file folders and, more particularly, to file folders of the type which are customarily used to secure loose papers within the folder.

BACKGROUND OF THE INVENTION

File folders are commonly used in combination with metal fasteners for securing papers within the folder. Those metal fasteners generally comprise an elongate body with projecting prongs. The fasteners and folders are supplied separately, and when they are to be used, the prongs of the fastener are bent over and pushed through slits in the folder so that the body of the fastener is outside the folder and the prongs are inside. The loose papers are punched and placed over the prongs on the inside of the folder, after which the prongs are bent down against the inside of the folder. But, this type of folder and fastener combination are subject to the criticism that the bodies of the fasteners are exposed and tend to catch and damage other adjacent file folders when the folders are filed. These exposed portions of the fasteners can also damage furniture.

SUMMARY OF THE INVENTION

According to the practice of this invention, there is provided in combination a folder and a fastener for securing loose papers to the folder; the folder having a first panel with first and second opposed faces and first and second opposed parallel side edges and a cover strip; the fastener comprising an elongate strip of sheet material, the fastener having a central body portion and a pair of opposed prongs extending from opposite ends of the central body portion; the first panel having an internal flap formed from material of the first panel and being defined by a parting line that terminates at spaced first and second ends and a hinge line extending between the first and second ends, the flap being pivotal about the hinge line between a first position in which it is flush with the panel and a second position in which it projects upwardly from the first face of the panel, thereby to define an opening in the panel; the cover strip being secured to the panel on the second face of the panel, the cover strip being larger than the opening and overlying the opening; and the folder further having a securing means for securing the flap to the cover strip with the body portion of the fastener sandwiched between the flap and the cover strip with the prongs extending upwardly from the first face of the first panel.

The flap may be elongate and rectangular, having a width that is greater than the width of the body portion of the fastener and a length slightly smaller than that of the body portion so that the flap may fit between the bent prongs. Alternatively, the flap may have a length that is greater than that of the body portion and the flap may have a pair of transversely oriented slots that are spaced apart a distance equal to the length of the body portion so that the bent prongs may pass through the slots it will be appreciated that with such a rectangular flap, the hinge line may comprise one long side of the rectangle with the other three sides being defined by the parting line.

The securing means may comprise a layer of adhesive on that side of the flap facing the cover strip and a peel-off strip on the layer of adhesive. Alternatively, the layer of adhesive may be provided on that side of the cover strip facing the flap, again with a peel-off strip on the layer of adhesive.

The panel may have a third edge that is perpendicular to the first and second edges, with the hinge line of the flap being parallel to and spaced from the third edge. The parting line may then be on the opposite side of the hinge line to the third edge or it may be between the hinge line and the third edge.

The folder may have two panels which are joined together along a fold line that extends between the first and second edges of the first panel. This hinge line may then define a third edge of the first panel. As indicated above, the hinge line of the flap may be spaced from this fold line. Or, alternatively, the hinge line and the fold line may coincide with the parting line extending inwardly from the fold line into the first panel.

It will be appreciated by those skilled in the art that in an embodiment having two panels joined along a fold line with the flap extending parallel to the fold line, the cover strip may extend for the full length of the folder and may be located on both sides of the fold line so that it reinforces the folded edge of the folder.

The invention will be more readily apparent from the following description of the drawings in which.

Figure 1:
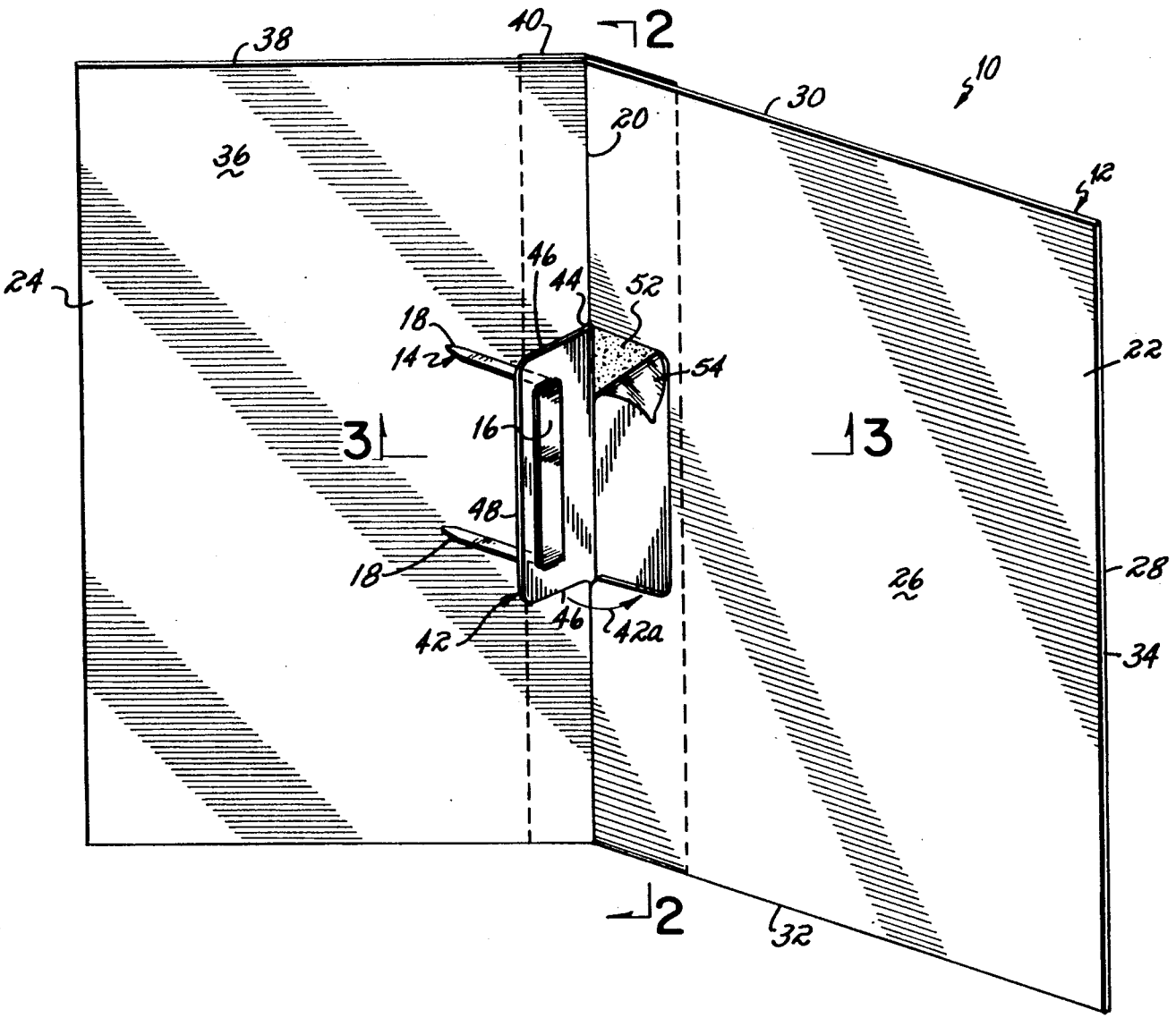
FIG. 1 is a perspective view of a first embodiment of a folder and fastener combination in accordance with the invention of this application.
Figure 2:
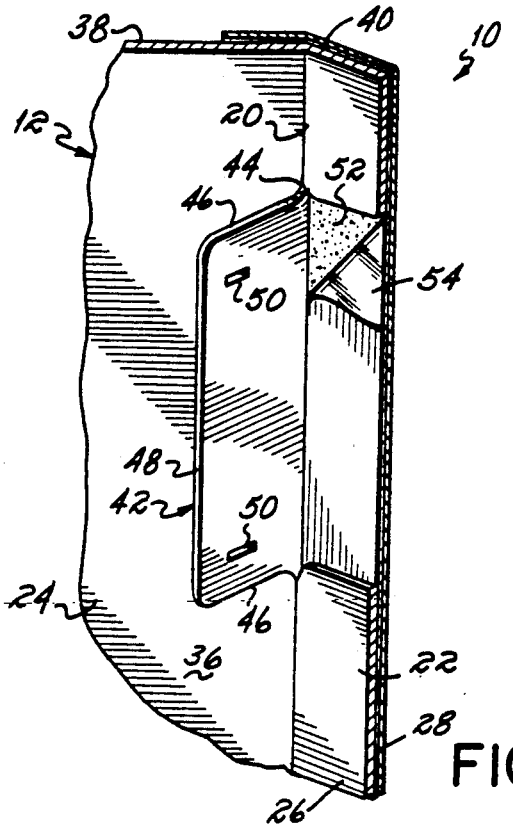
FIG. 2 is a cross-sectional view taken along line 2—2 of FIG. 1, but with the fastener removed.
Figure 3:
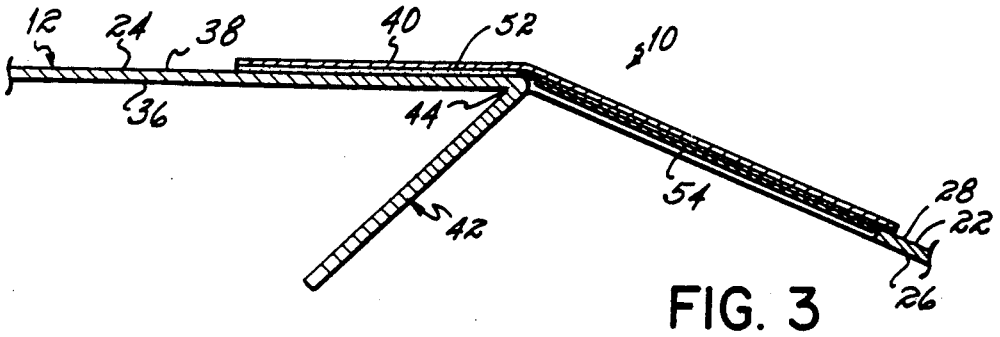
FIG. 3 is a cross-sectional view taken along line 3—3 of FIG. 1, but with the fastener removed.

Referring to FIGS. 1, 2 and 3, a folder and fastener combination in accordance with the invention is designated generally by reference number 10. The combination 10 comprises a folder 12 and a fastener 14.

The fastener 14 is of a soft metal, such as brass or mild steel, and is a flat, elongate strip having a body portion 16 with two prongs 18 extending from opposite ends of the body portion 16.

The folder 12 is of cardboard or similar rigid, flat sheet material and comprises a sheet thereof which has a central fold line 20 to provide two panels 22 and 24. It is to be understood that the term "cardboard" is used in a generic sense to cover a thin, relatively rigid sheet of any suitable material, which may be pasteboard or a synthetic plastics material or a composite material.

The panel 22 has an inner face 26, an outer face 28, a top edge 30, a bottom edge 32, a left edge defined by the fold line 30, and a right edge 34.

It will be appreciated that the panel 24 also has an inner face 36 and an outer face 38.

A cover strip 40 is adhesively secured to the outer faces 28 and 38 of the panels 22 and 24 about the fold line 20. The cover strip 40 runs the full length of the folder between the top edge 30 and the bottom edge 32.

A flap 42 is cut out from the panel 22 and is thus formed from the material of the panel 22. The flap 42 is formed from the material of the panel 22. The flap 42 is elongate and is located between the top edge 30 and bottom edge 32 of the panel 22. The flap 42 is secured to the folder 12 along a hinge line 44 which, in this embodiment, coincides with the fold line 20. The flap 42 is formed by score lines which define top and bottom short edges 46 extending outwardly from the hinge line 44 and a straight edge 46 that is parallel to and spaced from the hinge line 44.

As the flap 42 is cut or scored from the panel 22, the edges 46 and 48 define a parting line. When the flap 42 is lifted from the plane of the panel 22 to the position illustrated in FIGS. 1 and 2, it will be appreciated that there is an opening formed in the panel 22, which opening is complementary in shape to the flap 42. Otherwise expressed, the flap 42 is pivotable about the hinge line 44 between a first position in which it is flush with the panel 22 and a second position in which, as shown in FIG. 1, it projects outwardly from the inner face 26.

It will be noted that in this embodiment, the flap 42 is longer than the body portion 16 of the fastener 14. The flap 42 has two transverse slots 50 which are spaced apart a distance equal to the length of the body portion 16 so that the bent prongs 18 of the fastener 14 may pass therethrough. In order to assemble the fastener 14 to the folder 12, the prongs 18 of the fastener are passed through the slots 50 with the body portion 16 being located on that side of the flap 42 facing the panel 22.

The cover strip 40 is sufficiently wide so that it overlies the opening created by the flap 42 in the panel 22. The cover strip 40 has a layer of contact adhesive 52 on the inside surface thereof. This layer of contact adhesive 52 secures the cover strip 40 to the outside surfaces 28, 38 of the panels 22, 36, respectively. This layer of adhesive 52 is exposed to the inside of the folder through the opening in the panel 22 created by the flap 42. Until the folder 12 is assembled to the fastener 14 and the flap 42 is adhered to the cover strip 40, the opening created by the flap 42 is covered by a peel-off strip 54 of contact paper.

Figure 4:
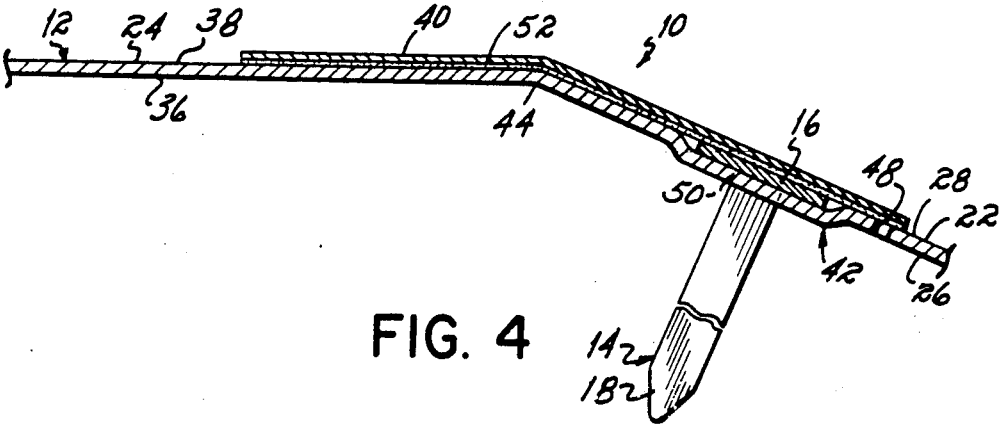
FIG. 4 is a cross-sectional view similar to FIG. 3, but with the fastener in its operative position rather than the assembly position illustrated in FIG. 1.

It will be understood that the folder 12 and fastener 14 are sold and shipped separately, with the fastener 14 in a flat state. The folder and fastener are maintained separate until the combination is ready for use. To use the folder and fastener combination, the prongs 18 of the fastener 14 are bent over, and the prongs 18 are passed through the slots 50 in the flap 42 as shown in FIG. 1. The peel-off strip 54 of contact paper is removed from the opening in the panel 22 created by the flap 42 and the flap 42 with the fastener 14 assembled thereto is pivoted towards the panel 22, as indicated by the arrows 42*a*, until the flap 42 fills the opening formerly occupied by the peel-off strip 54. The exposed or outside face of the flap 42 and the body portion 16 of the fastener then contact the expose layer of adhesive 52 on the cover strip 40 and, as shown in FIG. 4, are thereby secured thereto with the body portion 16 of the fastener sandwiched between the outside surface of the flap 42 and the inside surface of the cover strip 40.

Figure 5:
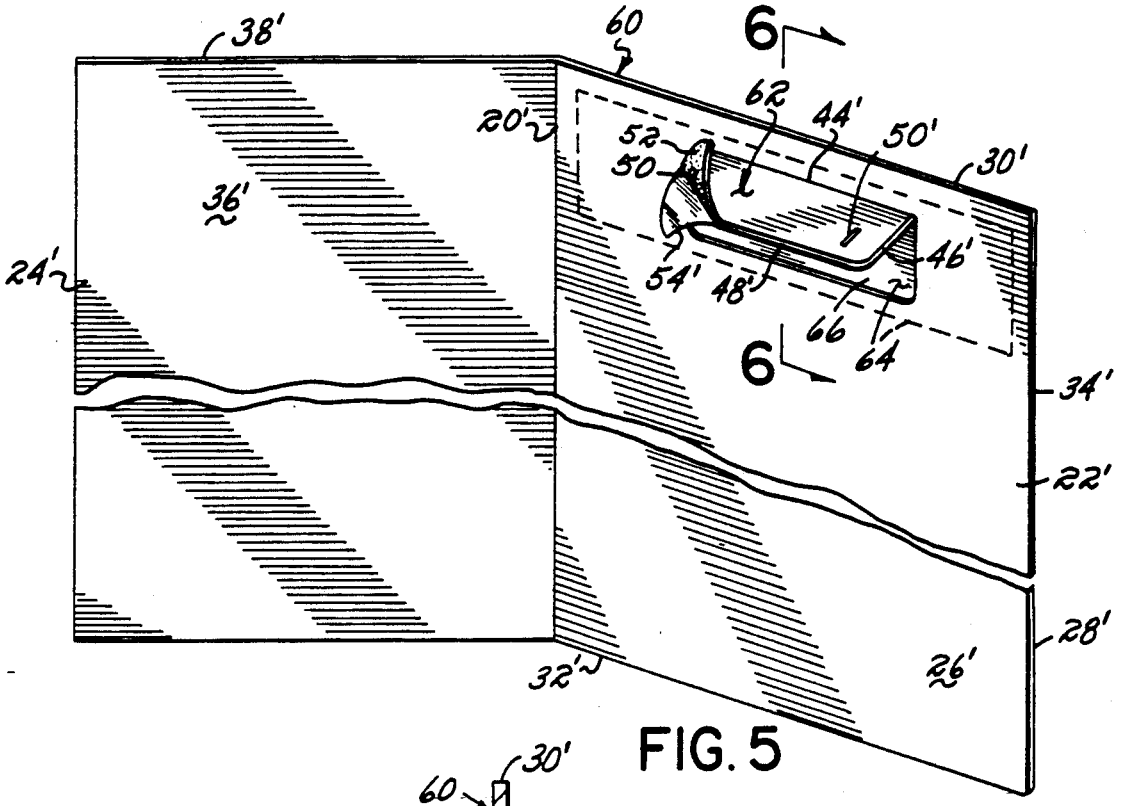
FIG. 5 is a perspective view of a second embodiment of the inventive folder of this application, but with the fastener removed.
Figure 6:
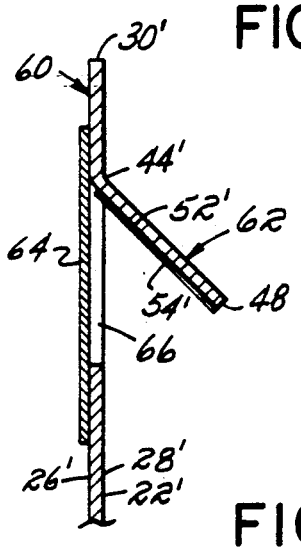
FIG. 6 is a cross-sectional view taken along line 6—6 of FIG. 5.
Figure 8:
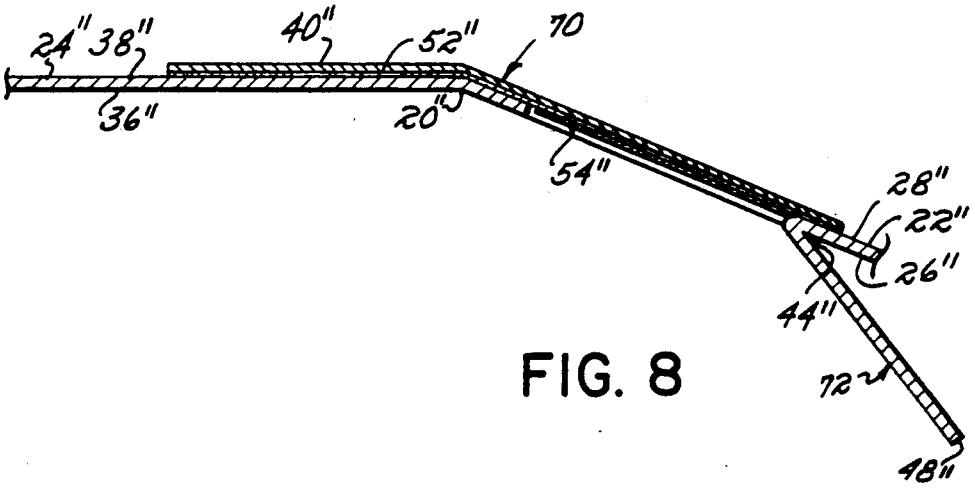
FIG. 8 is a cross-sectional view taken along line 8—8 of FIG. 7.
Figure 7:
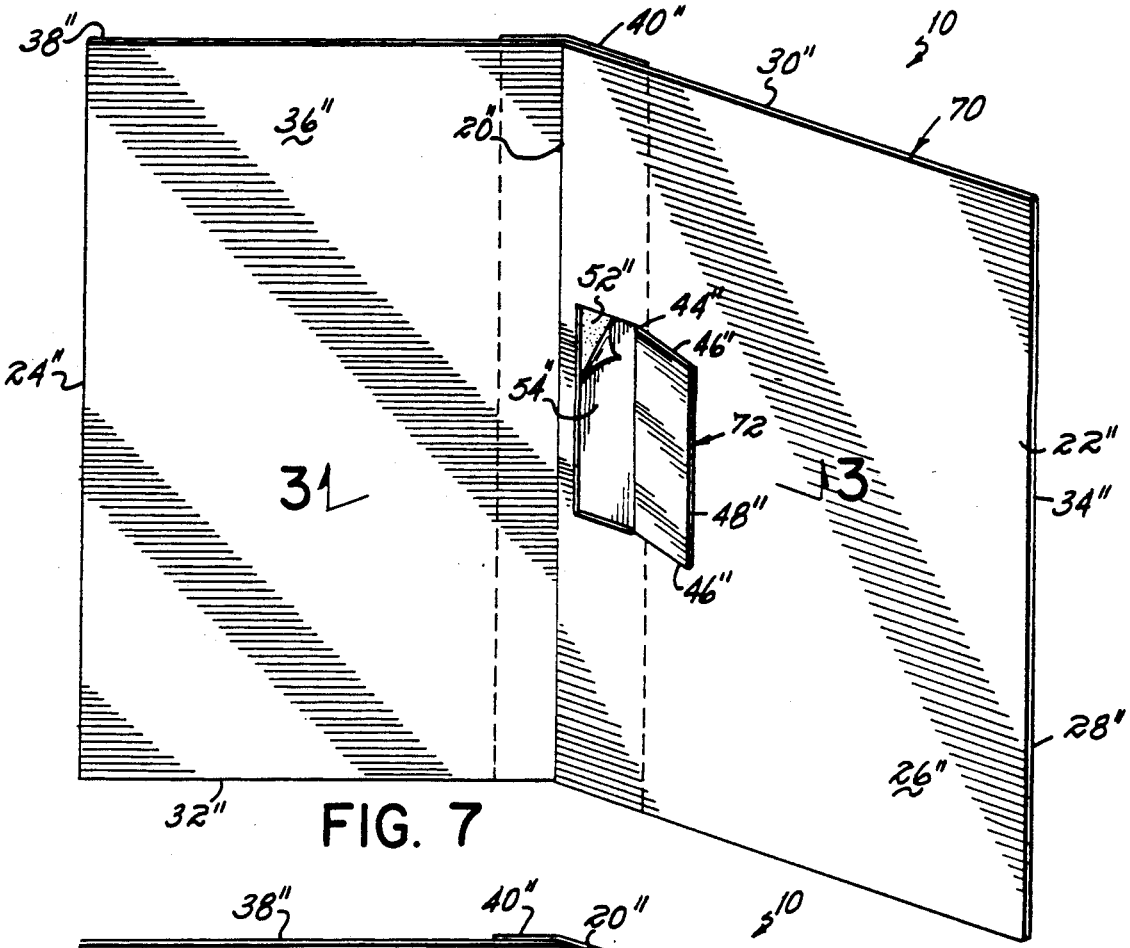
FIG. 7 is a perspective view of a third embodiment of the inventive folder of this application, again with the fastener removed.
Figure 9:
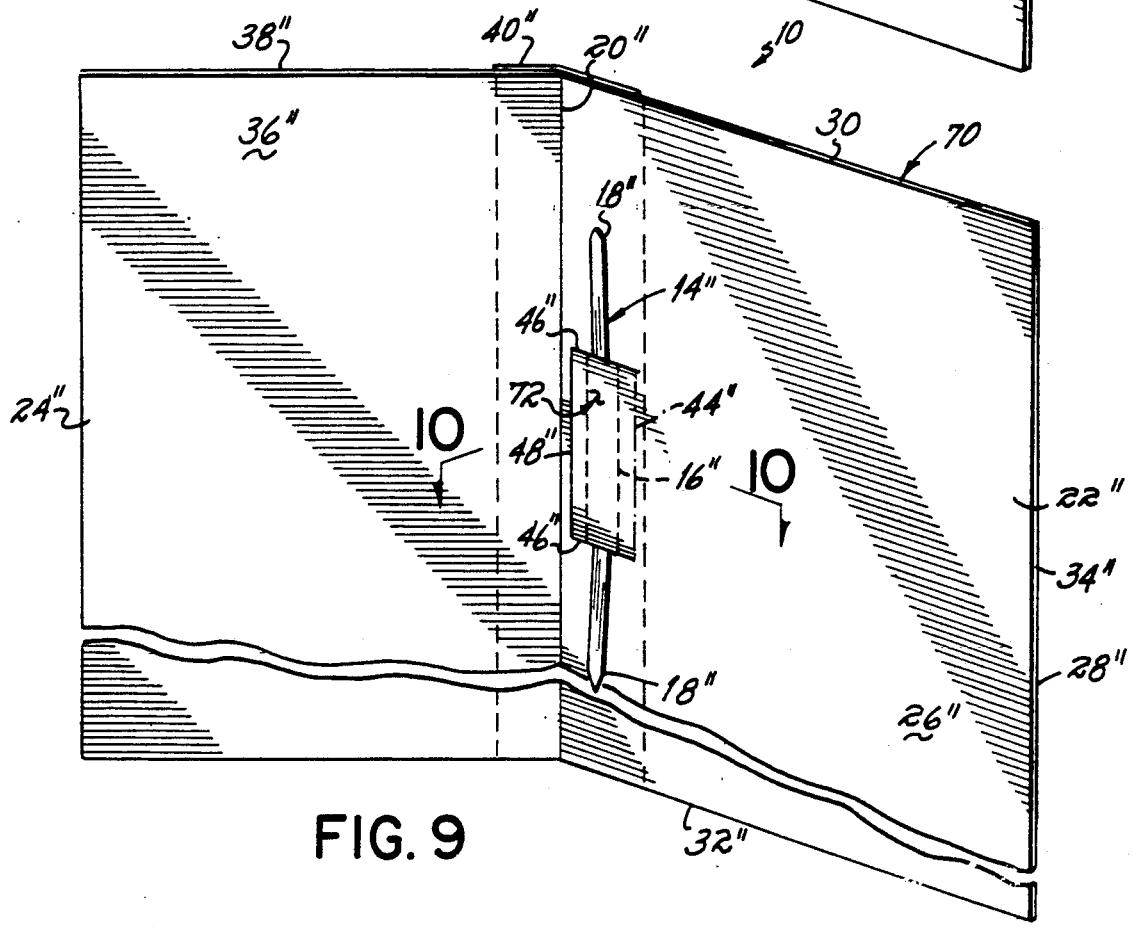
FIG. 9 is a perspective view of the folder of FIG. 7 after attachment of a fastener illustrating the folder and fastener combination in their operative configuration.
Figure 10:
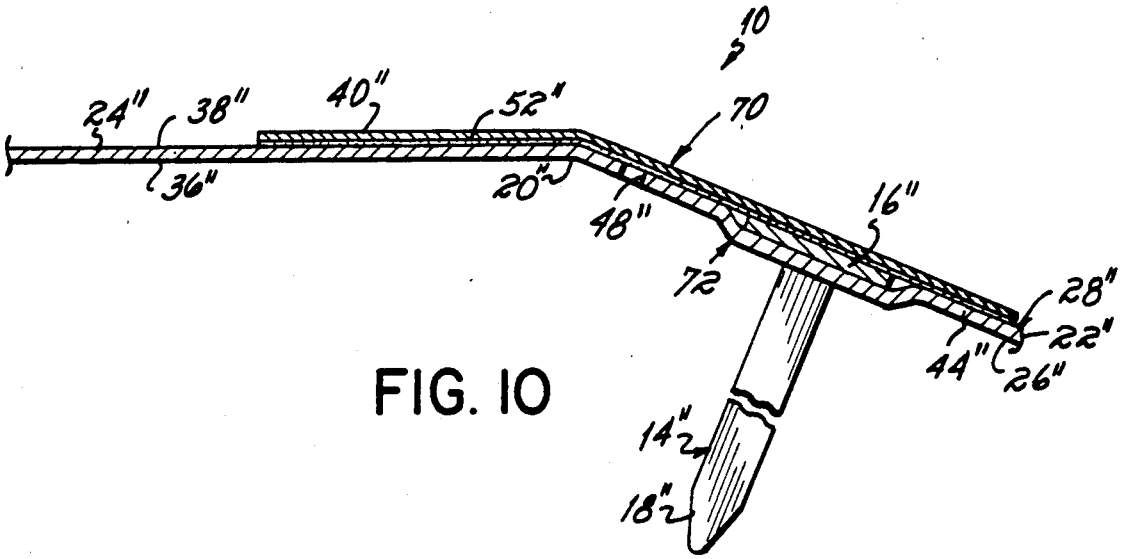
FIG. 10 is a cross-sectional view taken along line 10—10 of FIG. 9.

A second embodiment of a folder in accordance with the invention is shown in FIGS. 5 and 6 and is designated by reference number 60. This folder 60 is similar to the folder 12 of FIGS. 1–4. In this embodiment, those elements which are identical or which correspond to elements of the embodiment of FIGS. 1–4 have been given identical numerical designations followed by a prime mark. However, in this embodiment, the flap 62 is located between the fold line 20' and the right edge 34' of the panel 22'. The flap 62 is positioned near the top edge 30' of the panel 22' with the hinge line 44' of the flap 62 extending parallel to the top edge 30'. The flap 62 is rectangular and is defined by spaced edges 46' which extend outwardly from the hinge line 44' and are connected by a horizontal edge 48' which extends parallel to the hinge line 44'. A rectangular cover strip 64 of this embodiment extends between the fold line and the right edge 34' and is adhered to the outside surface 28' of the panel 22' so as to overlie the opening 66 in the panel 22'. With this embodiment, the adhesive layer 52' is provided on the outside surface of the flap 62 on that side thereof facing the opening 66 created by the formation of the flap 62. A peel-off strip 54' of contact paper is carried by the adhesive 52' on the outside surface of the flap 62. The folder 60 and a fastener (not shown) are used in the same manner as the fastener and folder of the first embodiment of FIGS. 1 and 4 to create a folder fastener combination when the folder 60 is ready for use.

Referring now to FIGS. 7–10, there is illustrated a still further embodiment of a folder and fastener combination in accordance with the invention. The fastener 14'' is identical to that shown in FIGS. 1 and 4. Further, the folder 70 shown in FIGS. 7–10 is similar to the folder 12 of the first embodiment. In this embodiment, those elements of the embodiment which are identical or which correspond to elements of the first embodiment of FIGS. 1–4 have been given identical numerical designations followed by a double-prime mark. This embodiment differs from the embodiment of FIGS. 1-4 principally in that the flap 72 of the folder 70 has a hinge line 44,, that is spaced inwardly from the fold line 20,, This flap 72 is rectangular, like the flap 62 of the folder 60 shown in FIGS. 5 and 6. Further, the flap 72 is now as long as the flap 42, being the same length as the body portion 16 of the fastener so that the flap 72 can fit between the prongs 18, the slots 50 not being necessary. With this embodiment, the prongs 50 are bent over and the body portion 16 is then gripped between the flap 72 and the cover strip 40.

In the use of the folder 70 and fastener 14'' combination of the embodiment of FIGS. 7–10, the peel-off strip 54'' of contact paper is removed from over the opening in the panel 22'' created by the formation of the flap 72 in that panel. After removal of the peel-off strip, the body portion 16'' of the fastener 14'' is secured to the inside surface of the cover strip 40'' by the contact adhesive 52''. The flap 72 is then folded about the hinge line 44'' into the opening created by the formation of the flap 72. The flap 72 then engages the adhesive 52'' on the inside of the cover strip 40'' and thereby secures the body portion 16'' of the fastener 14'' between the flap 14'' and the cover strip 40''.

The embodiment of FIGS. 7–10 has the advantages over the first embodiment of FIGS. 1–4 or the second embodiment of FIGS. 5 and 6 of more securely maintaining the flap of the panel adhered to the cover strip when the folder is in use with papers filed in the folder.

When those papers are lifted upwardly in the file folder, they tend in the first two embodiments to pull the flap away from the cover strip, but in the third embodiment (FIGS. 7–10), the lifted papers tend to force the flap down against the cover strip and the fastener.

While we have described only three embodiments of the invention, persons skilled in the art to which the invention pertains will appreciate other changes and modifications which may be made without departing from the spirit of the invention. Therefore, we do not intend to be limited except by the scope of the following claims.

We claim:

1. In combination, a folder and a fastener for securing loose papers to the folder, said folder having a first panel with first and second opposed faces and first and second opposed parallel side edges, a cover strip, said fastener comprising an elongate strip of sheet material, said fastener having a central body portion and a pair of opposed prongs extending from opposite ends of the central body portion, said first panel having an internal flap formed from material of said first panel and being defined by a parting line that terminates at spaced first and second ends and a hinge line extending between said first and second ends, said flap being pivotal about said hinge line between a first position in which it is flush with said panel and a second position in which it projects upwardly from said first face of said panel thereby to define an opening in said panel, said cover strip being secured to said panel on said second face of said panel, said cover strip being larger than said opening and overlying said opening, and said folder further having securing means adapted to secure the flap to the cover strip with said body portion of said fastener sandwiched between said flap and said cover strip and with said prongs extending upwardly from said first face of said first panel.

2. The combination of claim 1 wherein said flap is elongate and has a width that is greater than the width of said body portion of said fastener, said flap having a length slightly smaller than that of said body portion whereby said flap may fit between said prongs.

3. The combination of claim 1 wherein said flap is elongate and has a width that is greater than that of said body portion of said fastener, said flap having a length that is greater than that of said body portion, and said flap having a pair of transversely oriented slots that are spaced apart a distance equal to said length of said body portion whereby said prongs of said fastener may pass through said slots.

4. The combination of claim 1 wherein said securing means comprises a layer of adhesive on that side of said flap facing said cover strip and a peel-off contact strip over said layer of adhesive.

5. The combination of claim 1 wherein said securing means comprises a layer of adhesive on that side of said cover strip facing said flap and a peel-off contact strip over said layer of adhesive.

6. The combination of claim 1 wherein said flap is elongate and extends between said first and second side edges and said panel has a third edge which is perpendicular to said first and second edges.

7. The combination of claim 6 wherein said hinge line is parallel to and spaced from said third edge.

8. The combination of claim 7 wherein said parting line is on the opposite side of said hinge line from said third edge.

9. The combination of claim 7 wherein said parting line is between said hinge line and said third edge.

10. The combination of claim 1 wherein said folder has a second panel joined to said first panel along a fold line, said fold line extending between said first and second side edges of said first panel, said fold line defining a third edge of said first panel, said fold line and said hinge line being colinear.

11. The combination of claim 1 wherein said folder has a second panel joined to said first panel along a fold line, said fold line extending between said first and second side edges of said first panel, said fold line defining a third edge of said first panel, said fold line and said hinge line being parallel and offset from one another.

12. A folder for use in combination with a fastener for securing loose papers to the folder, said folder comprising a first panel with first and second opposed faces and first and second opposed parallel side edges, said first panel having an internal flap formed from material of said first panel and being defined by a parting line that terminates at spaced first and second ends and a hinge line extending between said first and second ends, said flap being pivotal about said hinge line between a first position in which it is flush with said panel and a second position in which it projects upwardly from said first face of said panel thereby to define an opening in said panel, a cover strip, said cover strip being secured to said panel on said second face of said panel, said cover strip being larger than said opening and overlying said opening, and said folder further having securing means adapted to secure the flap to the cover strip with a central portion of a fastener sandwiched between said flap and said cover strip and with end prongs of the fastener extending upwardly from said first face of said first panel.

* * * * *

UNITED STATES PATENT AND TRADEMARK OFFICE

CERTIFICATE OF CORRECTION

PATENT NO. : 5,007,758

DATED : April 16, 1991

INVENTOR(S) : Murray B. Blumberg

It is certified that error appears in the above-identified patent and that said Letters Patent is hereby corrected as shown below:

Column 1
Line 61
Change "slots it will" to read as ---slots. it will--
Column 3
Line 64
Change "the expose layer" to read as ---the exposed layer---

Column 4
Line 42
Change "line 44,," to read as ---line 44''--
Column 4
Line 42
Change "line 20,," to read as ---line 22''.---

Signed and Sealed this

Twenty-seventh Day of October, 1992

*Attest:*

DOUGLAS B. COMER

*Attesting Officer*

*Acting Commissioner of Patents and Trademarks*